US011371661B2

(12) United States Patent
Li et al.

(10) Patent No.: US 11,371,661 B2
(45) Date of Patent: Jun. 28, 2022

(54) BULB LAMP

(71) Applicants: OPPLE LIGHTING CO., LTD., Shanghai (CN); SUZHOU OPPLE LIGHTING CO., LTD., Suzhou (CN)

(72) Inventors: Chaoguang Li, Shanghai (CN); Yisheng Xiao, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/352,971

(22) Filed: Jun. 21, 2021

(65) Prior Publication Data

US 2021/0310618 A1 Oct. 7, 2021

Related U.S. Application Data

(63) Continuation of application No. PCT/CN2019/127184, filed on Dec. 20, 2019.

(51) Int. Cl.

| | |
|---|---|
| ***F21K 9/232*** | (2016.01) |
| ***F21V 29/70*** | (2015.01) |
| ***F21V 29/89*** | (2015.01) |
| ***F21K 9/238*** | (2016.01) |
| ***F21K 9/237*** | (2016.01) |
| ***F21V 17/16*** | (2006.01) |

(52) U.S. Cl.

CPC ..... *F21K 9/232* (2016.08); *F21K 9/237* (2016.08); *F21K 9/238* (2016.08); *F21V 17/164* (2013.01); *F21V 29/70* (2015.01); *F21V 29/89* (2015.01)

(58) Field of Classification Search

CPC ..... F21K 9/232; F21K 9/237; F21K 9/238; F21K 9/66; F21V 17/164; F21V 29/70; F21V 29/89; F21V 23/005; F21Y 2103/33; F21Y 2115/10

See application file for complete search history.

(56) References Cited

U.S. PATENT DOCUMENTS

| | | | | |
|---|---|---|---|---|
| 9,239,159 | B2 * | 1/2016 | Takenaka | F21V 29/773 |
| 2011/0234078 | A1 * | 9/2011 | Choi | F21K 9/60 313/46 |

(Continued)

FOREIGN PATENT DOCUMENTS

| | | | |
|---|---|---|---|
| CN | 202719420 | U | 2/2013 |
| CN | 202868373 | U | 4/2013 |

(Continued)

OTHER PUBLICATIONS

International Search Report of PCT Application No. PCT/CN2019/127184 dated Mar. 20, 2020 with English translation, (6p).

*Primary Examiner* — Peggy A Neils
(74) *Attorney, Agent, or Firm* — Arch & Lake LLP

(57) ABSTRACT

The present disclosure discloses a bulb lamp, which includes a lamp cap, a lamp holder and a bulb shell. The bulb holder connects the lamp cap and the bulb shell to form a lamp body, and a light source assembly is provided in the lamp body; the bulb lamp further includes a heat radiator, the heat radiator is arranged in the lamp holder, the heat radiator includes a first hollow mechanism, a contact part is provided at one end, away from the lamp cap, of the radiator, and the light source assembly is arranged on the contact part.

19 Claims, 6 Drawing Sheets

(56) References Cited

U.S. PATENT DOCUMENTS

| | | | | |
|---|---|---|---|---|
| 2014/0240994 | A1* | 8/2014 | Lim | F21V 29/83 362/382 |
| 2015/0098229 | A1* | 4/2015 | Tamura | F21V 23/007 362/382 |

FOREIGN PATENT DOCUMENTS

| | | | |
|---|---|---|---|
| CN | 203384665 | U | 1/2014 |
| CN | 204176395 | U | 2/2015 |
| CN | 205480499 | U | 8/2016 |
| CN | 106704858 | A | 5/2017 |
| CN | 207179231 | A | 4/2018 |
| CN | 207750765 | U | 8/2018 |
| CN | 209012824 | U | 6/2019 |
| JP | 2016162735 | A | 9/2016 |

* cited by examiner

BULB LAMP

CROSS-REFERENCE TO RELATED APPLICATIONS

This application is based upon and claims the priority of PCT patent application No. PCT/CN2019/127184 filed on Dec. 20, 2019 which claims priority to the Chinese patent application No. 201822168493.6 filed on Dec. 21, 2018, the entire content of both of which is hereby incorporated by reference herein for all purposes.

TECHNICAL FIELD

The present disclosure relates to a field of lighting technology, and in particular to a bulb lamp.

BACKGROUND

In the field of lighting technology, Light-emitting diode (LED) bulbs mainly include plastic-clad aluminum, rear-mounted aluminum, Driver On Board (DOB) optical engine, and photoelectric separation optical engine schemes. Besides the factors of light distribution, heat dissipation, power supply and structure design, the selection of architecture schemes depends more on the material and process cost.

SUMMARY

Examples of the present disclosure provide a bulb lamp and a method of manufacturing a bulb lamp.

The examples of the present disclosure provide a bulb lamp. The bulb lamp may include a lamp cap, a lamp holder, and a bulb shell, where the lamp holder may connect the lamp cap and the bulb shell to form a lamp body, and a light source assembly may be provided in the lamp body; and a heat radiator, where the heat radiator may be arranged in the lamp holder, the heat radiator may include a first hollow mechanism, a contact part may be provided at one end, away from the lamp cap, of the heat radiator, and the light source assembly may be arranged on the contact part.

The examples of the present disclosure provide a method of manufacturing a bulb lamp. The method may include providing a lamp cap, a lamp holder, and a bulb shell; connecting the lamp holder with the lamp cap and the bulb shell to form a lamp body, and providing a light source assembly in the lamp body; providing a heat radiator, and arranging the heat radiator in the lamp holder; and providing the heat radiator with a first hollow mechanism, providing a contact part at one end, away from the lamp cap, of the heat radiator, and arranging the light source assembly on the contact part.

It is to be understood that both the foregoing general description and the following detailed description are exemplary and explanatory only and are not restrictive of the present disclosure.

BRIEF DESCRIPTION OF THE DRAWINGS

The drawings described herein are used to provide a further understanding of the present disclosure and form a part of the present disclosure. The illustrative examples of the present disclosure and the descriptions thereof are used to explain the present disclosure and do not constitute an improper limitation of the present disclosure. In the drawings.

DETAILED DESCRIPTION

Figure 1:
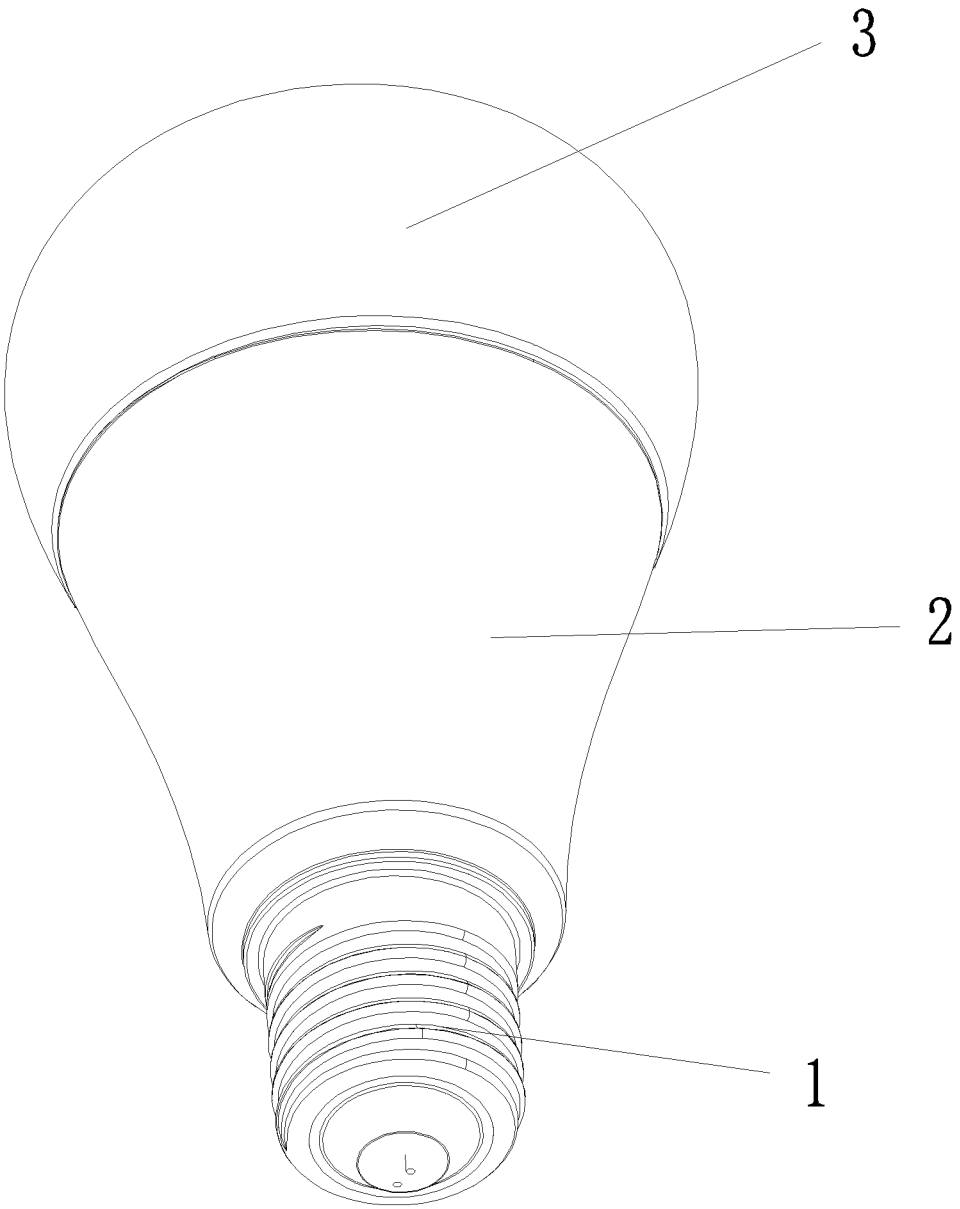
FIG. 1 is a three-dimensional structure diagram of a bulb lamp disclosed in the examples of the present disclosure.

For more clarity of the purpose, technical schemes and advantages of the present disclosure, the technical schemes of the present disclosure will be described clearly and completely below in combination with the examples of the present disclosure and the corresponding drawings. The described examples are only part of the examples of the present disclosure, not all of them. Based on the examples in the present disclosure, all other examples obtained by the person of ordinary skill in the art without making creative work shall fall within the protection scope of the present disclosure.

The heat dissipation of the plastic-clad aluminum lamp body scheme is better than that of the rear-mounted aluminum lamp body scheme, but the molding yield and efficiency are relatively low, and the cost is slightly higher than that of the rear-mounted aluminum lamp body scheme. With the maturity of the inlaid aluminum integrated injection molding process, the cost of the plastic-clad aluminum lamp body scheme and the cost of the rear-mounted aluminum lamp body scheme are getting closer and closer, and the plastic-clad aluminum scheme has more feasibility in the design of high-power bulbs due to its advantages in heat dissipation.

With the popularization and promotion of automatic production process of bulbs, the DOB scheme has become more and more automated in the production process, the optical engine has gradually transitioned from a photoelectric separation scheme to a half paste and half-plug-in DOB scheme, and has gradually evolved into a full paste DOB optical engine scheme. Among them, from the plastic-clad aluminum scheme to the rear-mounted aluminum scheme, to the DOB optical engine scheme and to the photoelectric separation optical engine scheme, the cost level of power paste materials is gradually decreasing, the cost difference between plug-in materials and paste materials is getting smaller and smaller, and the manual operation process and mode are gradually decreasing.

With the continuous development of material forming and processing technology level in lighting industry, different suppliers have different process capabilities. There are many different optimal combinations of bulb architecture schemes among different system suppliers, however, there is no bulb lamp scheme that can simultaneously take into account plastic-clad aluminum scheme, rear-mounted aluminum scheme, DOB optical engine scheme, and photoelectric separation optical engine scheme; and the lamp body needs to be fixed with additional perforations, so the process is complex and the sealing performance is not good; and the bulb lamp has the problem of poor heat dissipation.

The technical schemes provided by the examples of the present disclosure are described in detail below in combination with the drawings.

Reference numbers used in this disclosure may include: lamp cap 1, lamp holder 2, first clamping groove 21, limit block 22, wedge-shaped buckle 23, first fixation block 231, second fixation block 232, convex part 24, third clamping groove 241, inner surface 25, first annular mechanism 26, second annular mechanism 27, bulb shell 3, first buckle 31, limit slots 32 and 33, light source assembly 4, second clamping groove 41, light source substrate 42, light-emitting component 43, rotation hole 44, heat radiator 5, contact part 51, outer surface 52, and fourth clamping groove 53.

Figure 2:
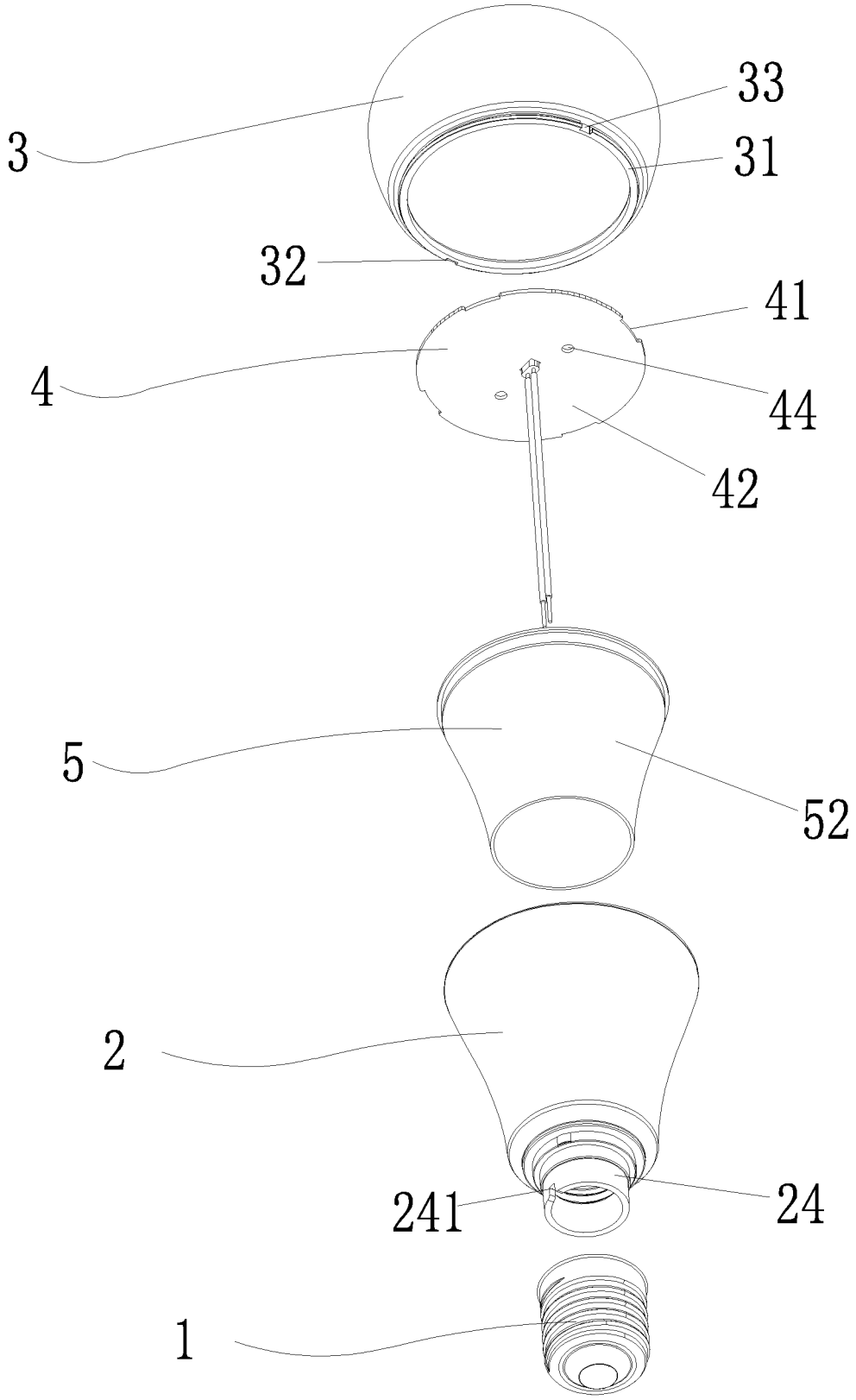
FIG. 2 is an explosion structure diagram of a bulb lamp disclosed in the examples of the present disclosure.
Figure 3:
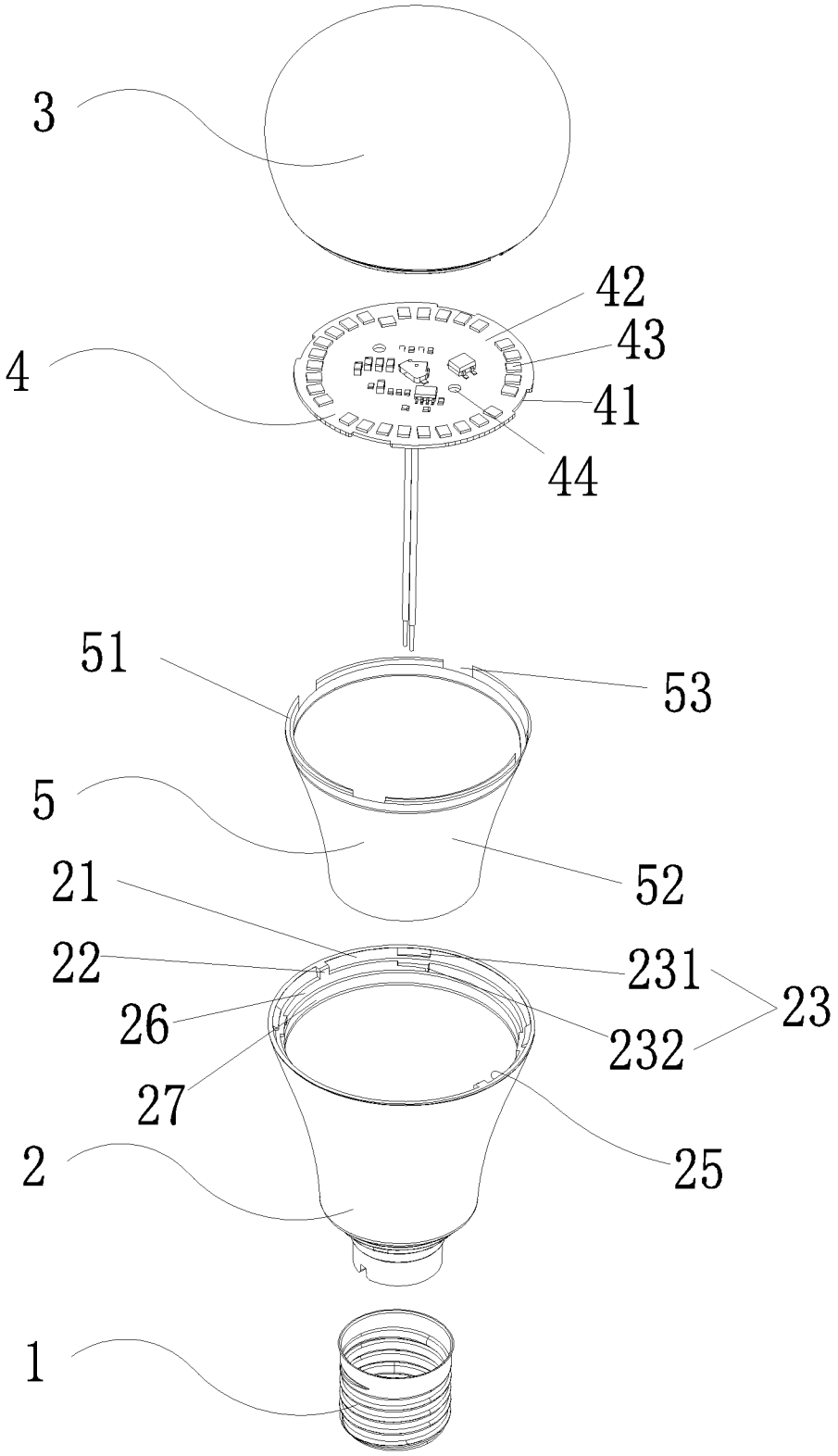
FIG. 3 is another explosion structure diagram of a bulb lamp disclosed in the examples of the present disclosure.

As shown in FIG. 1, FIG. 2 and FIG. 3, an example of the disclosure provides a bulb lamp, which includes a lamp cap 1, a lamp holder 2 and a bulb shell 3, the lamp holder 2 connects the lamp cap 1 and the bulb shell 3 to form a lamp body, and a light source assembly 4 is provided in the lamp body; the bulb lamp further includes a heat radiator 5, the heat radiator 5 is arranged in the lamp holder 2, the heat radiator 5 includes a first hollow mechanism, a contact part 51 is arranged at one end, facing away from the lamp cap 1, of the heat radiator 5, and the light source assembly 4 is arranged on the contact part 51. By contacting the light source assembly with the contact part on the heat radiator, the present disclosure realizes the heat conduction of the light source assembly, and by conducting and radiating the heat into the air through the lamp body, the direct contact heat dissipation is better and faster, and there is no need to perforate, the sealing is better, and the process is simple.

The light source assembly 4 may be a DOB optical engine scheme or a photoelectric separation optical engine scheme, the heat radiator 5 is arranged in the lamp holder 2 through the plastic-clad aluminum scheme or the rear-mounted aluminum scheme, the bulb lamp scheme of the present disclosure can simultaneously take into account the plastic-clad aluminum scheme, the rear-mounted aluminum scheme, the DOB optical engine scheme, and the photoelectric separation optical engine scheme, which has stronger compatibility.

Figure 5:
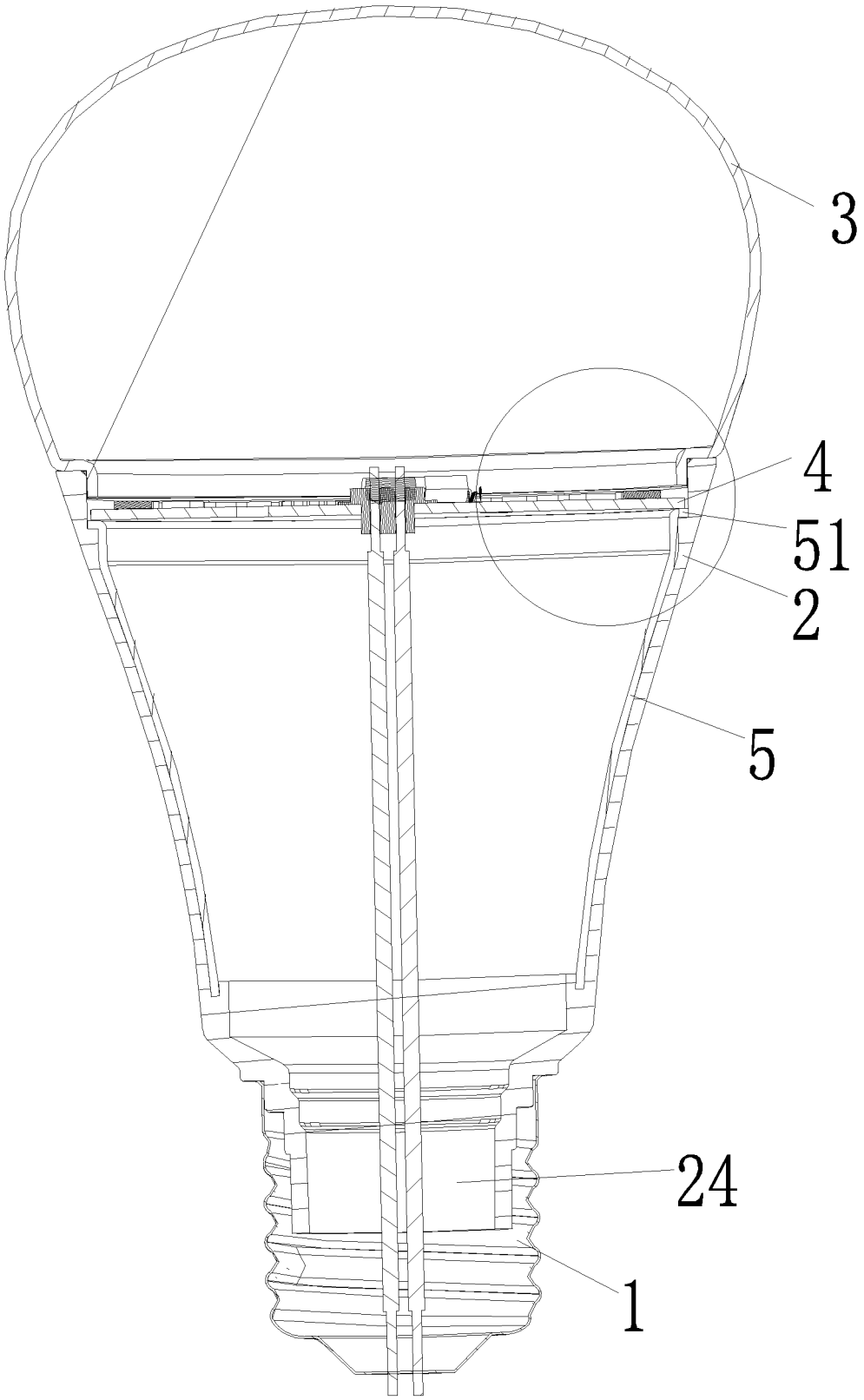
FIG. 5 is a cross-sectional diagram of a bulb lamp disclosed in the examples of the present disclosure.
Figure 6:
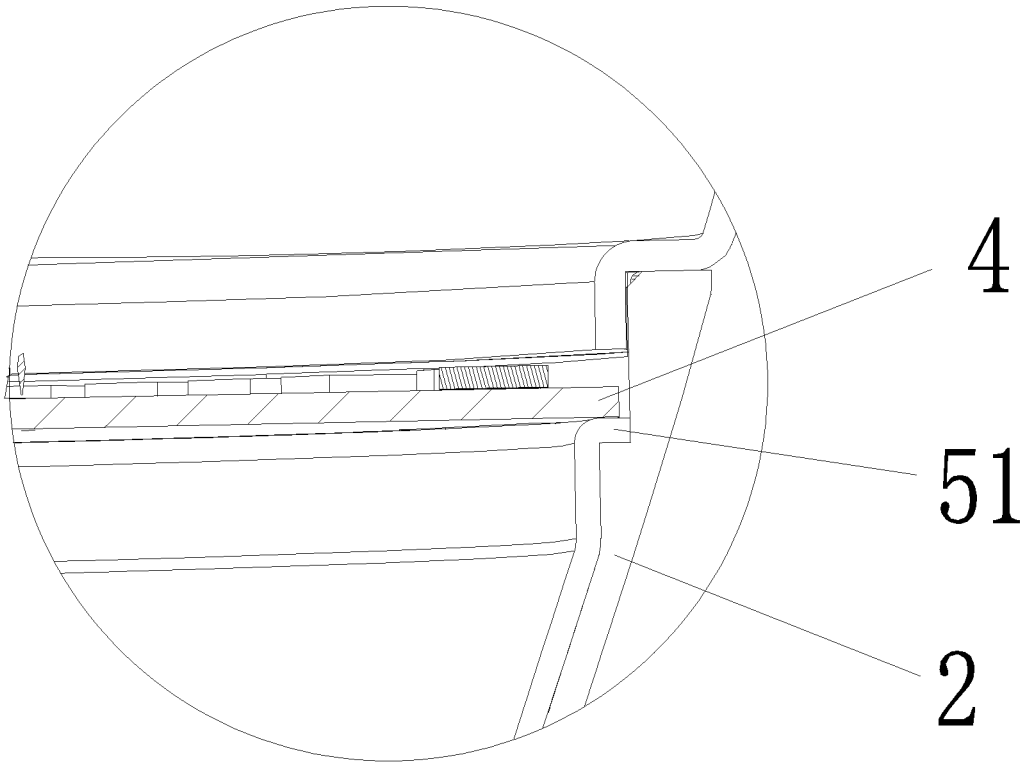
FIG. 6 is a partial structure diagram of FIG. 5.

As shown in FIG. 3, FIG. 5 and FIG. 6, the contact part 51 includes a flanging structure. The flanging structure 51 is a horizontal bearing surface that is folded outward from the top of the inner wall of the heat radiator 5; the bottom of the light source assembly 4 is arranged on the folded horizontal bearing surface.

The wall thickness of the heat radiator 5 ranges from 0.8 mm to 1.0 mm, and the thickness of the contact part 51 ranges from 0.8 mm to 1.0 mm. Preferably, the contact part 51 is integrally provided with the heat radiator 5.

As shown in FIG. 2, FIG. 3, FIG. 5 and FIG. 6, the lamp holder 2 includes a second hollow mechanism; along a direction away from the lamp cap 1, a first clamping groove 21, a first annular mechanism 26 and a second annular mechanism 27 are successively arranged on an inner surface 25 of the lamp holder 2 along a direction from the bulb shell 3 to the lamp cap 1; and the first clamping groove 21, the first annular mechanism 26 and the second annular mechanism 27 are arranged in a stepped manner along a direction from the inner surface 25 of the lamp holder 2 to the outer surface 52 of the heat radiator 5; the contact part 51 is clamped on the second annular mechanism 27; and a first buckle 31 cooperating with the first clamping groove 21 is arranged on the bulb shell 3. The first buckle 31 of the bulb shell 3 is installed in the first clamping groove 21 of the lamp holder 2, without perforation, thereby avoiding the situation that the plane connection needs to be glued and sealed, the sealing process is simple, and the sealing performance is good.

As shown in FIG. 2 and FIG. 3, a limit slot 32 is arranged on the first buckle 31, and a limit block 22 cooperating with the limit slot 32 is arranged on the first clamping groove 21. In an example of the present disclosure, there are two limit blocks 22, and a limit slot 32 and a limit slot 33 are arranged on the first buckle 31, the limit slot 32 and the limit slot 33 are respectively connected to the two limit blocks 22, and the two limit blocks 22 are symmetrically arranged on the lamp holder 2 in the form of a circular array. The symmetrical clamping arrangement is more stable, and the bulb shell 3 can be quickly installed on the lamp holder 2 through the limit block 22 and the limit slot 32, and the installation is more convenient.

As shown in FIG. 2 and FIG. 3, on the bulb lamp of the present disclosure, a wedge-shaped buckle 23 is arranged at one end, provided with the first clamping groove 21, of the lamp holder 2, and the light source assembly 4 is fixed in the lamp holder 2 through the wedge-shaped buckle 23.

Preferably, at least two wedge-shaped buckles 23 are arranged on the lamp holder 2. The symmetrically arranged wedge-shaped buckles 23 can ensure that the light source assembly 4 does not shake, and the installation is more stable.

As shown in FIG. 2 and FIG. 3, the wedge-shaped buckle 23 comprises a first fixture block 231 and a second fixture block 232, which are symmetrically arranged along the direction away from the lamp cap, the first fixture block 231 is arranged on the first clamping groove 21, the second fixture block 232 is arranged on the first annular mechanism 26, a second clamping groove 41 cooperating with the second fixture block 232 is arranged on the light source assembly 4, a fourth clamping groove 53 is arranged on the heat radiator 5, and the fourth clamping groove 53 is configured to avoid the first fixture block 231 and the second fixture block 232, thus along a circumferential direction of the second annular mechanism 27, a length of the fourth clamping groove 53 is greater than a length of the first fixture block 231; the light source assembly 4 is connected on the second fixture block 232, a bottom of the light source assembly 4 is in contact with the contact part 51, and the first fixture block 231 is clamped on the first buckle 31. Preferably, the first buckle 31 is in a L-shaped structure, and the first fixture block 231 is clamped on the L-shaped structure.

In an example of the present disclosure, the fourth clamping groove 53 is a gap between two adjacent contact parts 51, that is, the fourth clamping groove 53 and the contact part 51 are alternately on the top of the heat radiator 5. In an example of the present disclosure, the contact part 51, the fourth clamping groove 53, the second clamping groove 41, and the wedge-shaped buckle 23 are all four, and they are symmetrically arranged in the form of a circular array on the heat radiator 5, the light source assembly 4 and the circumference of the lamp holder 2. In a case that the heat radiator 5 and the light source assembly 4 are installed in the lamp holder 2 in this disclosure, the fourth clamping groove 53 on the heat radiator 5 passes through the first fixation block 231 and the second fixation block 232, and is fixed in the lamp holder 2 by means of rear-mounted aluminum or inlaid aluminum integrated injection molding; align the second clamping groove 41 of the light source assembly 4 in the direction of the first fixation block 231, allow the second clamping groove 41 to pass through the first fixation block 231 and the second fixation block 232, and then rotate the light source assembly 4 to clamp the second clamping groove 41 on the second fixation block 232.

Figure 4:
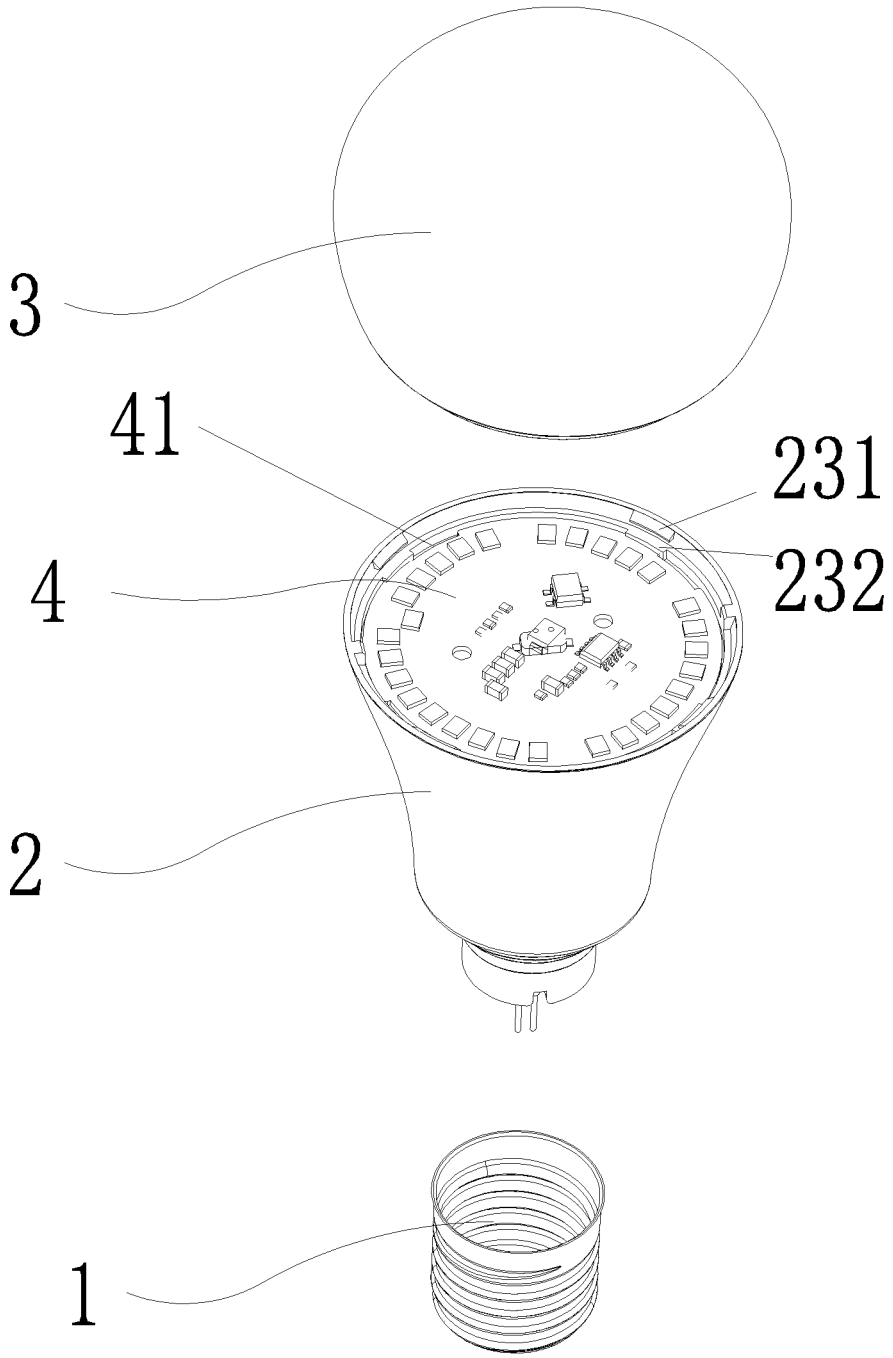
FIG. 4 is another explosion structure diagram of a bulb lamp disclosed in the examples of the present disclosure.

As shown in FIG. 3 and FIG. 4, the second fixture block 232 is in an inverted L-shaped structure, and one end of the inverted L-shaped structure is clamped in the second clamping groove 41. The L-shaped structure enables the light source assembly 4 to be firmly fixed on lamp holder 2, and the connection is more stable.

As shown in FIG. 2, a convex part 24 is arranged at one end of the lamp holder 2 along a direction away from the bulb shell 3, and the convex part 24 is arranged in the lamp cap 1.

As shown in FIG. 2, a third clamping groove 241 is arranged on the convex part 24 and configured for setting a power supply in the lamp cap 1. In a case that the light source assembly adopts the photoelectric separation optical engine scheme, the third clamping groove 241 is configured to fix the power supply of the photoelectric separation optical engine scheme.

As shown in FIG. 3, the light source assembly 4 comprises a light source substrate 42 and a light-emitting component 43, the light-emitting component 43 is arranged on the light source substrate 42 in a direction facing the bulb shell 3, and the bulb shell 3 is covered on the first buckle 31 of the lamp holder 2 through the first clamping groove 21.

As shown in FIG. 2 and FIG. 3, at least one rotation hole 44 is arranged on the light source substrate 42, and the rotation hole 44 is configured to rotate the light source substrate 42. The rotation hole 44 facilitates the rotation of the light source substrate 42, and the rotation is more convenient.

As shown in FIG. 2 and FIG. 3, the outer surface 52 of the heat radiator 5 is adhered to the inner surface 25 of the lamp holder 2.

As shown in FIG. 2 and FIG. 3, a material of the heat radiator 5 includes aluminum; and a material of the lamp holder 2 includes a thermally conducting material.

Examples of the present disclosure provide a bulb lamp and a method of manufacturing a bulb lamp to solve the problems of poor heat dissipation of the bulb lamp, additional perforation and fixation of the lamp body, complex process and poor sealing performance.

The examples of the present disclosure provide a bulb lamp, including a lamp cap, a lamp holder and a bulb shell, the lamp holder connects the lamp cap and the bulb shell to form a lamp body, and a light source assembly is provided in the lamp body.

The bulb lamp further comprises a heat radiator, the heat radiator is arranged in the lamp holder, the heat radiator comprises a first hollow mechanism, a contact part is arranged at one end, away from the lamp cap, of the heat radiator, and the light source assembly is arranged on the contact part. The light source assembly may be a DOB optical engine scheme or a photoelectric separation optical engine scheme, the heat radiator is arranged in the lamp holder through the plastic-clad aluminum scheme or the rear-mounted aluminum scheme, the bulb lamp schemes of the present disclosure can simultaneously take into account the plastic-clad aluminum scheme, the rear-mounted aluminum scheme, the DOB optical engine scheme, and the photoelectric separation optical engine scheme, which has stronger compatibility.

Optionally, in the bulb lamp above, the contact part comprises a flanging structure.

Optionally, in the bulb lamp above, the lamp holder comprises a second hollow mechanism; along a direction away from the lamp cap, a first clamping groove, a first annular mechanism and a second annular mechanism are successively arranged on an inner surface of the lamp holder along a direction from the bulb shell to the lamp cap; and the first clamping groove, the first annular mechanism and the second annular mechanism are arranged in a stepped manner along a direction from the inner surface of the lamp holder to an outer surface of the heat radiator; the contact part is clamped on the second annular mechanism; and a first buckle cooperating with the first clamping groove is arranged on the bulb shell.

Optionally, in the bulb lamp above, a limit slot is arranged on the first buckle, and a limit block cooperating with the limit slot is arranged on the first clamping groove.

Optionally, in the bulb lamp above, a wedge-shaped buckle is arranged at one end, provided with the first clamping groove, of the lamp holder, and the light source assembly is fixed in the lamp holder through the wedge-shaped buckle.

Optionally, in the bulb lamp above, at least two wedge-shaped buckles are arranged on the lamp holder.

Optionally, in the bulb lamp above, the wedge-shaped buckle comprises a first fixture block and a second fixture block, which are symmetrically arranged along the direction away from the lamp cap, the first fixture block is arranged on the first clamping groove, the second fixture block is arranged on the first annular mechanism, a second clamping groove cooperating with the second fixture block is arranged on the light source assembly, and a fourth clamping groove is arranged on the heat radiator, along a circumferential direction of the second annular mechanism, a length of the fourth clamping groove is greater than a length of the first fixture block, and the fourth clamping groove is configured to avoid the first fixture block and the second fixture block; the light source assembly is arranged on the second fixture block through the second clamping groove, a bottom of the light source assembly is in contact with the contact part; and the first fixture block is clamped on the first buckle.

Optionally, in the bulb lamp above, the second fixture block is in an inverted L-shaped structure, and one end of the inverted L-shaped structure is clamped in the second clamping groove.

Optionally, in the bulb lamp above, a convex part is arranged at one end of the lamp holder along a direction away from the bulb shell, and the convex part is arranged in the lamp cap.

Optionally, in the bulb lamp above, a third clamping groove is arranged on the convex part and configured for setting a power supply in the lamp cap.

Optionally, in the bulb lamp above, the light source assembly comprises a light source substrate and a light-emitting component, the light-emitting component is arranged on the light source substrate in a direction facing the bulb shell, and the bulb shell is covered on the first clamping groove of the lamp holder through the first buckle.

Optionally, in the bulb lamp above, at least one rotation hole is arranged on the light source substrate, and the rotation hole is configured to rotate the light source substrate.

Optionally, in the bulb lamp above, a wall thickness of the heat radiator is 0.8-1.0 mm, and a thickness of the contact part is 0.8-1.0 mm.

Optionally, in the bulb lamp above, the outer surface of the heat radiator is adhered to the inner surface of the lamp holder.

Optionally, in the bulb lamp above, a material of the heat radiator comprises aluminum; and a material of the lamp holder comprises a thermally conducting material.

At least one of the above technical schemes adopted in the examples of the present disclosure can achieve the following beneficial effects.

The present disclosure also provide a method of manufacturing a bulb lamp. The method may include: providing a lamp cap, a lamp holder, and a bulb shell; connecting the lamp holder with the lamp cap and the bulb shell to form a lamp body, and providing a light source assembly in the lamp body; providing a heat radiator, and arranging the heat radiator in the lamp holder; and providing the heat radiator with a first hollow mechanism, providing a contact part at one end, away from the lamp cap, of the heat radiator, and arranging the light source assembly on the contact part.

The method may also include providing the contact part with a flanging structure; providing the lamp holder with a second hollow mechanism; arranging, along a direction away from the lamp cap, a first clamping groove, a first annular mechanism and a second annular mechanism on an inner surface of the lamp holder along a direction from the bulb shell to the lamp cap; and arranging the first clamping groove, the first annular mechanism and the second annular mechanism in a stepped manner along a direction from the inner surface of the lamp holder to an outer surface of the heat radiator; and clamping the contact part on the second annular mechanism; and arranging a first buckle cooperating with the first clamping groove on the bulb shell.

The method may include arranging a limit slot on the first buckle, and arranging a limit block cooperating with the limit slot on the first clamping groove.

The method may include arranging at least two wedge-shaped buckles on the lamp holder; and providing the wedge-shaped buckle with a first fixture block and a second fixture block, arranging the first fixture block and the second fixture block along the direction away from the lamp cap, arranging the first fixture block on the first clamping groove, and arranging the second fixture block on the first annular mechanism, arranging a second clamping groove cooperating with the second fixture block on the light source assembly, and arranging a fourth clamping groove on the heat radiator, and providing, along a circumferential direction of the second annular mechanism, a length of the fourth clamping groove that is greater than a length of the first fixture block, and configuring the fourth clamping groove to avoid the first fixture block and the second fixture block; arranging the light source assembly on the second fixture block through the second clamping groove, providing a bottom of the light source assembly that is in contact with the contact part; and clamping the first fixture block on the first buckle.

The method may also include providing the second fixture block that is in an inverted L-shaped structure, and clamping one end of the inverted L-shaped structure in the second clamping groove.

The examples of the present disclosure disclose a bulb lamp, which realizes the heat conduction of the light source assembly by contacting the light source assembly with the contact part on the heat radiator, and by conducting and radiating the heat into the air through the lamp body, the direct contact heat dissipation is better and faster, and there is no need to perforate, the sealing is better, and the process is simple.

The above examples of the present disclosure mainly describe the differences between the various examples. As long as the different optimization features of the various examples are not contradictory, they can be combined to form another example. Considering the brevity of the text, it will not be repeated here.

The above are only examples of the present disclosure and are not used to limit the present disclosure. For those skilled in the art, the present disclosure may have various modifications and changes. Any modification, equivalent substitution, improvement, and the like made within the spirit and principle of the present disclosure shall be included in the scope of the present disclosure.

What is claimed is:

1. A bulb lamp, comprising:

a lamp cap, a lamp holder, and a bulb shell, wherein the lamp holder connects the lamp cap and the bulb shell to form a lamp body, and a light source assembly is provided in the lamp body; and a heat radiator, wherein the heat radiator is arranged in the lamp holder, the heat radiator comprises a first hollow mechanism, a contact part is provided at one end, away from the lamp cap, of the heat radiator, and the light source assembly is arranged on the contact part, and wherein the lamp holder comprises a second hollow mechanism;

along a direction away from the lamp cap, a first clamping groove, a first annular mechanism and a second annular mechanism are arranged on an inner surface of the lamp holder along a direction from the bulb shell to the lamp cap; and the first clamping groove, the first annular mechanism and the second annular mechanism are arranged in a stepped manner along a direction from the inner surface of the lamp holder to an outer surface of the heat radiator; the contact part is clamped on the second annular mechanism; and a first buckle cooperating with the first clamping groove is arranged on the bulb shell.

2. The bulb lamp according to claim 1, wherein the contact part comprises a flanging structure.

3. The bulb lamp according to claim 1, wherein a limit slot is arranged on the first buckle, and a limit block cooperating with the limit slot is arranged on the first clamping groove.

4. The bulb lamp according to claim 1, wherein a wedge-shaped buckle is arranged at one end, provided with the first clamping groove, of the lamp holder, and the light source assembly is fixed in the lamp holder through the wedge-shaped buckle.

5. The bulb lamp according to claim 4, wherein:

at least two wedge-shaped buckles are arranged on the lamp holder;

the wedge-shaped buckle comprises a first fixture block and a second fixture block, which are symmetrically arranged along the direction away from the lamp cap, the first fixture block is arranged on the first clamping groove, and the second fixture block is arranged on the first annular mechanism, a second clamping groove cooperating with the second fixture block is arranged on the light source assembly, and a fourth clamping groove is arranged on the heat radiator, and along a circumferential direction of the second annular mechanism, a length of the fourth clamping groove is greater than a length of the first fixture block, and the fourth clamping groove is configured to avoid the first fixture block and the second fixture block; the light source assembly is arranged on the second fixture block through the second clamping groove, a bottom of the light source assembly is in contact with the contact part; and the first fixture block is clamped on the first buckle.

6. The bulb lamp according to claim 5, wherein the second fixture block is in an inverted L-shaped structure, and one end of the inverted L-shaped structure is clamped in the second clamping groove.

7. The bulb lamp according to claim 1, wherein a convex part is arranged at one end of the lamp holder along a direction away from the bulb shell, and the convex part is arranged in the lamp cap.

8. The bulb lamp according to claim 7, wherein a third clamping groove is arranged on the convex part and configured for setting a power supply in the lamp cap.

9. The bulb lamp according to claim 4, wherein the light source assembly comprises a light source substrate and a light-emitting component, the light-emitting component is arranged on the light source substrate in a direction facing the bulb shell, and the bulb shell is covered on the first clamping groove of the lamp holder through the first buckle.

10. The bulb lamp according to claim 9, wherein at least one rotation hole is arranged on the light source substrate, and the rotation hole is configured to rotate the light source substrate.

11. The bulb lamp according to claim 1, wherein a wall thickness of the heat radiator is 0.8-1.0 mm, and a thickness of the contact part is 0.8-1.0 mm.

12. The bulb lamp according to claim 1, wherein an outer surface of the heat radiator is adhered to an inner surface of the lamp holder.

13. The bulb lamp according to claim 1, wherein a material of the heat radiator comprises aluminum; and a material of the lamp holder comprises a thermally conducting material.

14. A method of manufacturing a bulb lamp, comprising:

providing a lamp cap, a lamp holder, and a bulb shell;

connecting the lamp holder with the lamp cap and the bulb shell to form a lamp body, and providing a light source assembly in the lamp body;

providing a heat radiator, and arranging the heat radiator in the lamp holder;

providing the heat radiator with a first hollow mechanism, providing a contact part at one end, away from the lamp cap, of the heat radiator, and arranging the light source assembly on the contact part; and providing the lamp holder with a second hollow mechanism;

arranging, along a direction away from the lamp cap, a first clamping groove, a first annular mechanism and a second annular mechanism on an inner surface of the lamp holder along a direction from the bulb shell to the lamp cap; and arranging the first clamping groove, the first annular mechanism and the second annular mechanism in a stepped manner along a direction from the inner surface of the lamp holder to an outer surface of the heat radiator; and clamping the contact part on the second annular mechanism; and arranging a first buckle cooperating with the first clamping groove on the bulb shell.

15. The method of claim 14, further comprising:

providing the contact part with a flanging structure.

16. The method of claim 14, further comprising:

arranging a limit slot on the first buckle, and arranging a limit block cooperating with the limit slot on the first clamping groove.

17. The method of claim 14, further comprising:

arranging a wedge-shaped buckle at one end, provided with the first clamping groove, of the lamp holder, and fixing the light source assembly in the lamp holder through the wedge-shaped buckle.

18. The method of claim 17, further comprising:

arranging at least two wedge-shaped buckles on the lamp holder;

providing the wedge-shaped buckle with a first fixture block and a second fixture block, arranging the first fixture block and the second fixture block along the direction away from the lamp cap, arranging the first fixture block on the first clamping groove, and arranging the second fixture block on the first annular mechanism, arranging a second clamping groove cooperating with the second fixture block on the light source assembly, and arranging a fourth clamping groove on the heat radiator, and providing, along a circumferential direction of the second annular mechanism, a length of the fourth clamping groove that is greater than a length of the first fixture block, and configuring the fourth clamping groove to avoid the first fixture block and the second fixture block; arranging the light source assembly on the second fixture block through the second clamping groove, providing a bottom of the light source assembly that is in contact with the contact part; and clamping the first fixture block on the first buckle.

19. The method of claim 18, further comprising:

providing the second fixture block that is in an inverted L-shaped structure, and clamping one end of the inverted L-shaped structure in the second clamping groove.

* * * * *